United States Patent [19]

Buzzi et al.

[11] 4,295,834

[45] Oct. 20, 1981

[54] DRIVE MECHANISM FOR A WATERCRAFT WITH A SURFACE PROPELLER

[75] Inventors: Fabio Buzzi, Annone Brianza Como; Sergio Carniti, Oggiono Como, both of Italy

[73] Assignee: Carl Hurth Maschinen- und Zahnradfabrik GmbH & Co., Munich, Fed. Rep. of Germany

[21] Appl. No.: 58,168

[22] Filed: Jul. 17, 1979

[30] Foreign Application Priority Data

Jul. 18, 1978 [IT] Italy ..... 25840 A/78

[51] Int. Cl.[3] ..... B63H 5/16

[52] U.S. Cl. ..... 440/76

[58] Field of Search ..... 115/34 R, 35, 37, 39, 115/41 R, 41 HT; 440/49, 65, 75, 79, 82, 112; 114/5

[56] References Cited

U.S. PATENT DOCUMENTS 2,391,109 12/1945 van Patten ..... 440/49
3,933,116 1/1976 Adams et al. ..... 115/41 HT
4,031,846 6/1977 Tone ..... 115/35

FOREIGN PATENT DOCUMENTS 890890 11/1943 France ..... 115/35

*Primary Examiner*—Edward R. Kazenske
*Assistant Examiner*—Jesús D. Sotelo
*Attorney, Agent, or Firm*—Blanchard, Flynn, Thiel, Boutell & Tanis

[57] ABSTRACT

A drive mechanism for a watercraft having a surface propeller rotatingly driven by a motor arranged inboard of the watercraft through shafting which extends through an opening in a transom plate on the watercraft. The shafting includes a propeller shaft which is rotatably supported in a support arm which is mounted externally of the watercraft and on the aforesaid transom plate. The support arm is of a unitary construction and has appropriate openings therein to rotatably support the propeller shaft. Thrust bearings are provided on the support arm to absorb the thrust forces generated by the propeller. Due to the unitary construction of the support arm, the thrust forces generated by the propeller are transmitted only through rigid parts onto a flange plate on the support arm which in turn is fixedly secured to the transom plate.

14 Claims, 10 Drawing Figures

DRIVE MECHANISM FOR A WATERCRAFT WITH A SURFACE PROPELLER

CROSS-REFERENCE TO RELATED APPLICATION

This application is related to copending application Ser. No. 91,443, filed Nov. 5, 1979.

FIELD OF THE INVENTION

The present invention relates to a drive mechanism for a watercraft having a surface propeller which is rotatingly driven from a motor arranged inboard of the watercraft and through appropriate shafting.

BACKGROUND OF THE INVENTION

A known drive mechanism for a surface propeller is one in which the motor which is inboard and the shafting to the propeller is arranged on a common carrier which is swingably fastened, if desired, through damping elements near the transom plate on the hull of the watercraft and devices are provided for varying the angle of inclination of the carrier to effect a varying of the depth of immersion of the propeller. In the case of surface propellers, the entire propeller is not immersed into the water, but projects more and more out of the water with increasing travelling speed, and at a maximum speed is approximately half way out of the water.

Such a drive mechanism through which the many disadvantages of the generally known Z-drive were to be avoided, brings about very good results in practical use, in particular in the case of racing boats. Due to the significant weight of the drive motor, however, which in most cases is a diesel motor, this drive is less suitable for leisure boats.

A drive mechanism having a surface propeller is known from U.S. Pat. No. 3,933,116 in which the motor is fixedly installed within the watercraft and the shaft which supports the propeller is connected to the motor through a universal joint. The propeller shaft is supported in an arm which is provided with a cavitation plate, which arm is swingably fastened at the rear of the watercraft both about a horizontal axis for varying the depth of immersion of the propeller and also about a vertical axis for controlling the vehicle. Thus the propeller thrust must be absorbed by the various hinge pins which is a disadvantage. A further disadvantage lies in the hydraulic devices for lifting and lowering the arm which must be relatively large because of the weight of the arm.

The foregoing disadvantages are avoided when the arm is secured rigidly with the propeller to the watercraft and the depth of immersion of the propeller is controlled by a trim rudder which is pivotal about a horizontal axis and which is connected to the cavitation plate. Such a device is known from U.S. Pat. No. 4,031,846. Due to the fact that the propeller thrust bearing is arranged within the watercraft in that device, the propeller shafts thus are supported partly in the vehicle and partly in the arm, as a result of which installation and removal of the arm are made more difficult. In addition, the devices which are needed for the operation of the rudder for controlling the vehicle are externally exposed on the arm, where they can be easily damaged and are not appealing in appearance, and appearance is desirable today, particularly in the case of leisure boats.

Starting out from this observation, the basic purpose of the invention is to provide a drive mechanism for a watercraft having a surface propeller in which the arm which supports the propeller shaft and the propeller is one complete structural unit, which unit is easily and efficiently mountable as a whole on the watercraft and which transmits the propeller thrust directly onto the vehicle rather than through other aggregate components. Aside from this, it is a purpose of this invention to provide a drive mechanism, as aforesaid, which has a closed appearance and is simple and inexpensive to manufacture.

These purpose are attained by a drive mechanism of the above-mentioned type in which the part of the shafting which supports the propeller is supported outside of the watercraft in a support arm secured rigidly to the vehicle by a flange plate, and a thrust bearing is housed within the support arm for transmitting the propeller thrust only through rigid parts and a large surface onto the watercraft. This drive mechanism is easily and efficiently manufactured and safe to operate, particularly when the support arm is of unitary construction, as this assures a high degree of rigidity and offers furthermore a stylistic design for the aggregate.

The thrust bearing keeps the propeller thrust away from the motor and instead is directs it on the shortest path to the hull of the watercraft. By arranging the propeller shaft thrust bearing in a bearing sleeve, the life expectancy of the bearings is increased by the use of low friction bearings which run in an oil bath provided in the bearing sleeve. A flange connection between the propeller shaft and the part of the shafting which is provided within the watercraft permits, simple installation and removal and allows use of an elastic coupling to compensate for angular deflections and alignment errors.

It is possible to arrange behind the propeller a blade of a steering rudder which is supported swingably on the support arm, with which blade the watercraft is controlled. Control pipelines and linkages for the rudder can be placed within the support arm so that they do not interfere with the flow of water and are protected from damage.

BRIEF DESCRIPTION OF THE DRAWINGS

The invention will be illustrated hereinafter with reference to an exemplary embodiment which is illustrated in FIGS. 1 to 10.

In the drawings.

DETAILED DESCRIPTION

Figure 1:
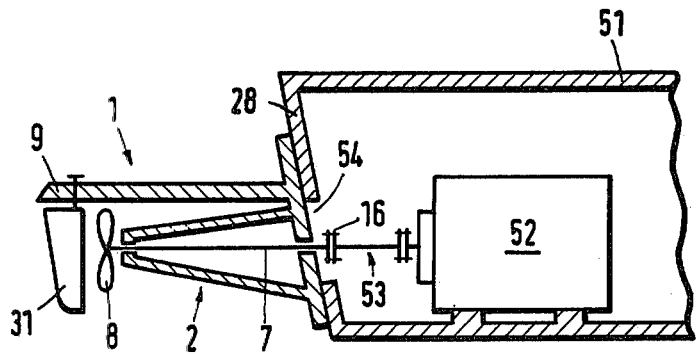
FIG. 1 illustrates schematically the attachment of the inventive drive mechanism on the watercraft.

FIG. 1 schematically illustrates a drive mechanism embodying the invention. A drive motor 52 is housed in the schematically illustrated watercraft 51, and is drivingly connected to the propeller shaft 7 of the drive mechanism 1 through a shaft 53 and couplings 16. The shaft 53 extends through an opening 54 in the transom plate 28. The drive mechanism 1 is fastened to the outside of the transom plate 28. The drive mechanism consists substantially of a support arm 2, in which is housed the propeller shaft 7. A propeller 8 is secured to the shaft 7 at the rear free end thereof and operatively engages the water. The propeller is positioned below a cavitation plate 9, on which is pivotally supported a steering rudder 31 for controlling the watercraft 51. The rudder 31 is positioned rearwardly of the propeller 8.

Figure 3:
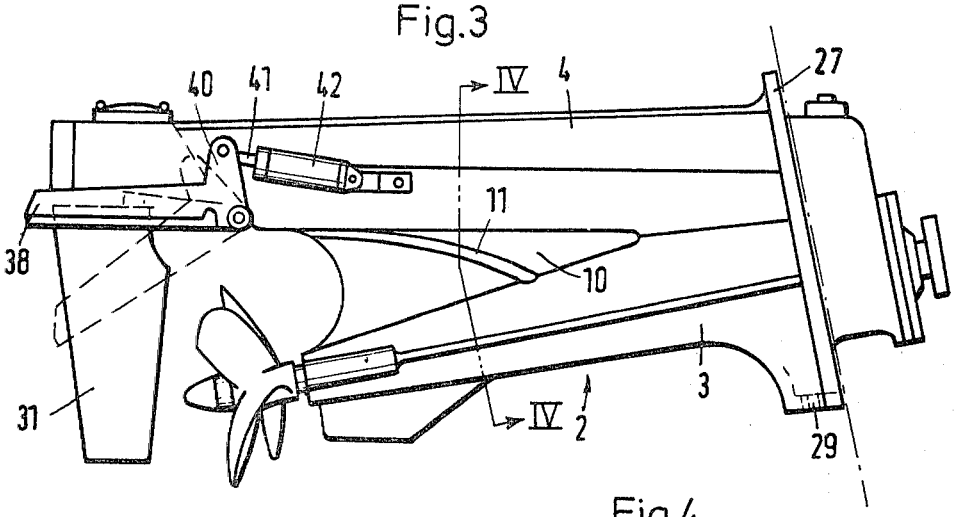
FIG. 3 is a side view of the drive mechanism embodying the invention.
Figure 4:
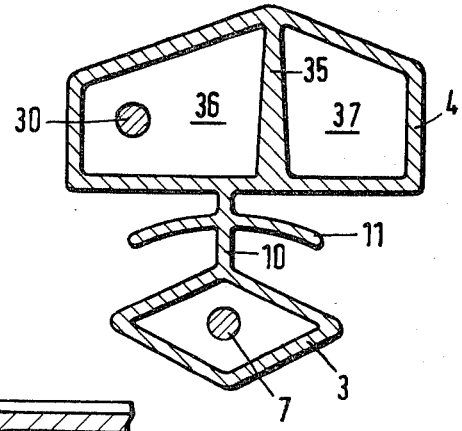
FIG. 4 is a cross-sectional view taken along the line IV—IV of FIG. 3.

The support arm 2 is of a one piece construction which has two vertically spaced hollow members namely, a lower arm part 3 and an upper arm part 4 connected by a vertical web 10 (FIGS. 3 and 4). To effect a fastening to the watercraft 51, primarily to the transom plate 28, the support arm 2 has a flange plate 27, which is dimensioned to define as much as possible a universal attachment permitting attachment of the drive mechanism to as many different boat types as possible. Water-guiding surfaces 11 extend laterally on the web 10, which surfaces are inclined to extend upwardly and rearwardly from the lower part 3 to the upper part 4 and are curved such that they are a segment of a bell surface which opens outwardly and rearwardly toward the propeller 8.

Figure 5:
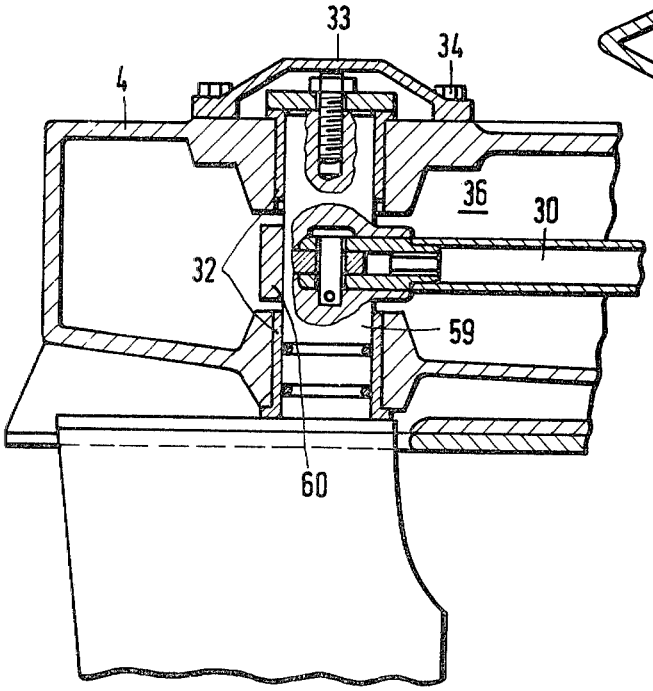
FIG. 5 is a fragmentary cross-sectional view of the rear upper portion of the drive mechanism illustrating the support for the rudder.
Figure 6:
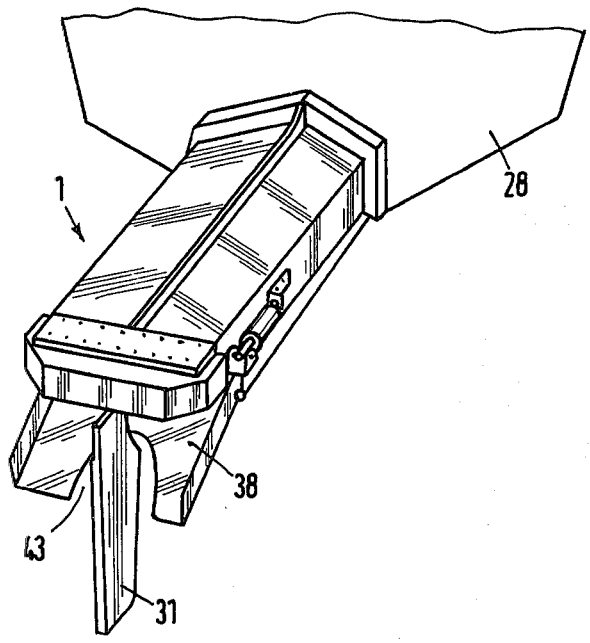
FIG. 6 is a perspective view of the drive mechanism as attached to a watercraft.

The support for the propeller shaft 7 located in th lower part 3 will be discussed below. The lower part 3 or the flange 27 can be equipped with connections for a cooling water supply and/or exhaust pipe for the drive motor 52. Such a connection is identified by the reference numeral 29 in FIG. 3. The upper part 4 is divided into two chambers 36, 37 having a partition wall 35 therebetween, of which one, chamber 37, passes exhaust emissions from the drive motor 52 to the surrounding environment. It is also possible to install an exhaust muffler (silencer) in the chamber 37. A linkage 30 is guided through the outer chamber 36 for facilitating an adjusting of the rudder 31. The rudder has a shaft 59 (FIG. 5) which is guided in bearing sleeves 32 arranged in the rear portion of the upper part 4 or the chamber 36. The linkage 30 is pivotally connected to a lever 60 which is fastened on the shaft 59 with structure that is known and therefore has not been shown or described in detail. A lid 33 is fastened above the upper end of the shaft 59 to the upper part 4 by screws 34. In addition, a trim rudder 38 is mounted on the upper part 4. The trim rudder is pivotal about a horizontal axis which is arranged in front of the rudder 31. For this, hydraulic cylinders 42 are provided on opposite sides of the upper part 4, which cylinders act through their piston rods 41 onto linkages 40 fixedly connected to the trim rudder. In order not to influence or hinder the pivotal requirements of the rudder 31, the trim rudder 38 is U-shaped, due to a recess 43 (FIG. 6) in the trailing edge, and the rudder 31 pivots freely in the recess 43 when the trim rudder is elevated to a horizontal position so as to extend rearwardly on both sides of the rudder 31.

Figure 2:
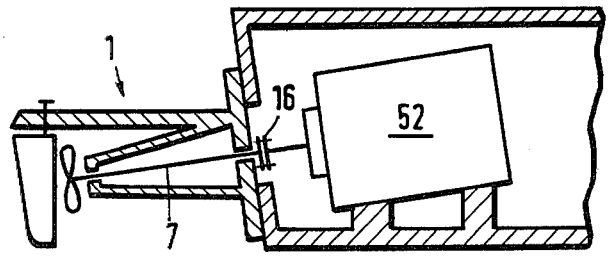
FIG. 2 illustrates schematically the attachment of a different inventive drive mechanism on the watercraft.
Figure 7:
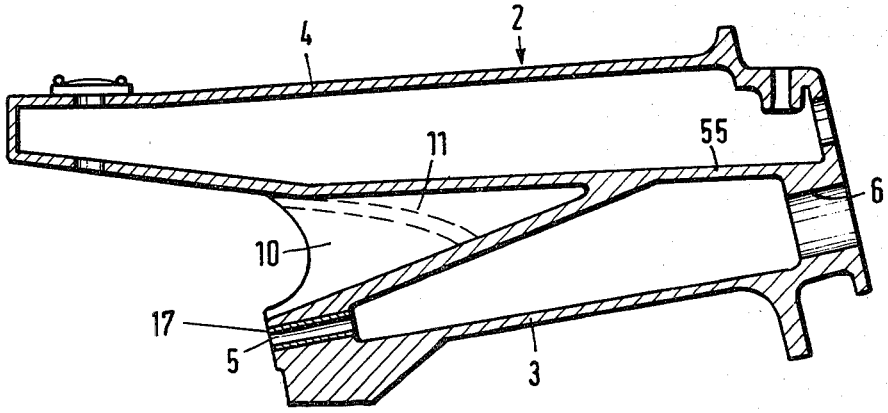
FIG. 7 is a cross-sectional view of the drive mechanism of FIG. 3.

The upper part 4 and the lower part 3 can be arranged at an acute angle to one another. (The attachment situation for this is schematically shown in FIG. 2, which at the same time illustrates an example of a direct connection of the drive motor 52 to the propeller shaft 7). They then have a common partition wall 55 over a portion of their length (FIG. 7) and the web 10 is correspondingly shorter. The information given hereinbelow for the propeller shaft and its support is true for the two designs of the support arm.

Figure 8:
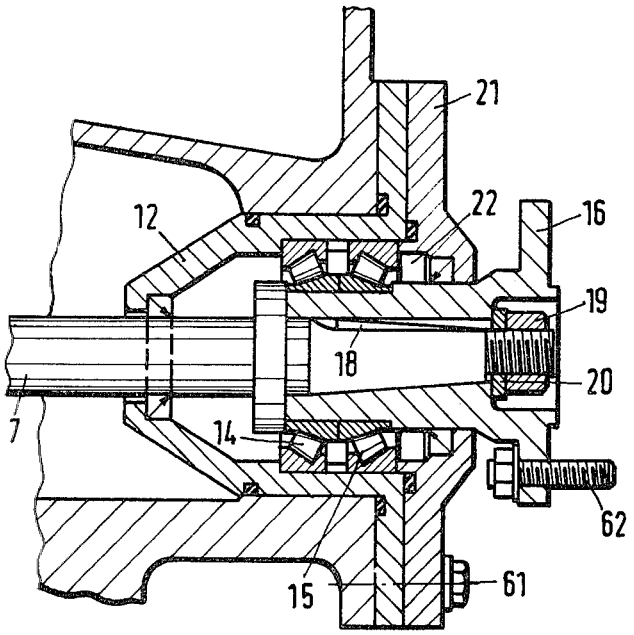
FIG. 8 is a cross-sectional view of the propeller shaft support in the drive mechanism.

The lower part 3 of the support arm 2 has coaxial receiving openings 5, 6, into which the support for the propeller shaft 7 is mounted. Directly in front of the propeller 8, which is fastened with known and not illustrated means to the propeller shaft 7, the opening 5 receives a bearing 17 therein, which can for example be a bearing bushing. However, it is also possible to use a low friction bearing which is sealed off against water penetration. The larger opening 6 at the front end which faces the transom plate 28 is designed for receiving a bearing sleeve 12 (FIG. 8) therein. The low friction bearings 14, 15 received in the bearing sleeve 12 in the opening 6 form the second support bearing for the propeller shaft 7 and also transfer the propeller thrust to the flange 27.

In the illustrated exemplary embodiment, a flange 16 having an adjusting spring is mounted fixed against rotation on the propeller shaft 7 and is held axially by a nut 19 and a washer 20. The bearing sleeve 12 is closed at the inner end by a lid 21. This entire unit, consisting of the bearing sleeve 12, low friction bearings 14, 15, flange 16 including fastening elements, propeller shaft 7 and lid 21 can be assembled externally of the support arm 2 and can be introduced completely into same. The screws which are necessary for fastening the preassembled unit to the support arm 2 are only schematically indicated and are identified by the reference numeral 61.

Figure 9:
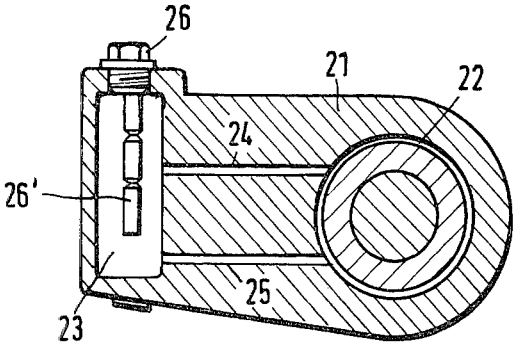
FIG. 9 is a cross-sectional view of a lid of the drive mechanism, illustrating an oil reservoir.

To facilitate a better heat discharge and to increase the life expectancy of the bearings, the low friction bearings 14, 15 run in an oil bath. For this purpose, the inside chamber 22 in the bearing sleeve 12 is filled with oil and suitable sealing elements, such as radial-shaft-packing rings and O-rings, are provided at all parting lines and at the openings for the shaft. To enlarge the oil volume, the lid 21 is further provided with a laterally located chamber 23 (FIG. 9), which defines an oil reservoir and is connected through passageways 24, 25 to the inside chamber 22. The oil level can be checked by using an oil-measuring dip stick 26' secured to a locking screw 26. The locking screw 26 is threadedly received in an opening in the lid 21. The driving connection of the drive shaft 7 to the motor 52 is provided by the flange 16 and, if desired, through intermediate shafting 53. Screws 62 or other suitable connecting elements are provided for this purpose.

Figure 10:
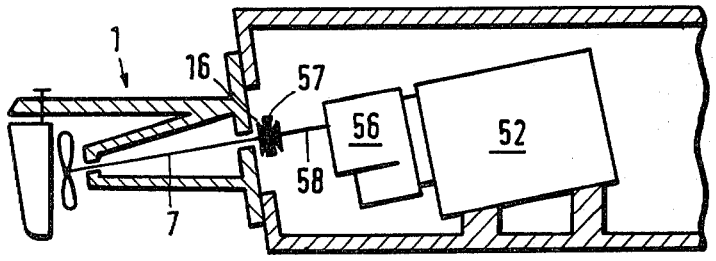
FIG. 10 illustrates a schematic arrangement of gearing which is the further modification of the drive mechanism embodying the invention.

A gear-shaft mechanism and/or a reversing gear 56 can in addition be arranged between the motor 52 and the drive mechanism 1 (FIG. 10). Its input shaft can be connected to the shafting 53 or connected as illustrated directly to the motor 52. Its driven shaft 58 is connected to the flange 16 of the propeller shaft 7.

To compensate for angular deflections and axle misalignments, it is possible to use an elastic coupling 57 or the like between the flange 16 and the shafting 53.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a drive mechanism for a watercraft having a surface propeller rotatingly driven by a drive motor arranged inboard thereof through shaft means which extends through a transom plate on the hull of said watercraft, the improvement comprising wherein a hollow support arm is provided and has a flange plate on one end thereof directly rigidly fastened to said transom plate of said watercraft, wherein said shaft means includes a substantially straight propeller shaft positioned on the outboard side of said transom plate and extending through the interior of said hollow support arm and having a propeller on one end thereof adjacent the free end of said support arm remote from said one end, wherein in the region of said flange plate there is arranged a propeller thrust bearing for facilitating a transmitting of the propeller thrust on said straight shaft to said flange plate and thence to said transom plate of said watercraft, and wherein said hollow support arm is of a unitary construction, and comprises a box-shaped lower part which extends in longitudinal direction with coaxial openings therein to facilitate the support of said propeller shaft therein and of a box-shaped upper part which also extends in longitudinal direction and is provided thereabove, which upper part is designed as a cavitation plate and projects at its rear end beyond the lower part, and wherein rib means are provided for connecting said upper and lower parts together, said rib means extending in longitudinal direction and on the front end thereof merging into said flange plate.

2. The drive mechanism according to claim 1, wherein said box-shaped upper part and said box-shaped lower part extend coextensively toward said flange plate at an acute angle such that said upper part is arranged substantially horizontally and said lower part is inclined thereto and both parts have a common partition wall over a portion of the length thereof.

3. The drive mechanism according to claim 1 or 2, wherein a bearing sleeve is arranged in the opening in the end of said support arm adjacent said transom plate, said bearing sleeve having low friction axial thrust bearings therein, said propeller shaft being rotatably supported in said bearings, said bearings absorbing the propeller thrust on said propeller shaft, and wherein said bearing sleeve is closed off against the outside by a lid member secured thereto.

4. The drive mechanism according to claim 3, wherein said bearing sleeve is at least partly filled with oil and said lid member has a chamber means defining an oil reservoir, said chamber means being connected to an inside chamber of said bearing sleeve and is closed off to the outside by a removable closure member.

5. The drive mechanism according to claim 4, wherein said removable closure member includes an oil-measuring stick.

6. The drive mechanism according to claim 1 or 2, wherein said propeller shaft carries a flange on its end adjacent said transom plate, through which said propeller shaft is connected to the part of said shaft means which is inboard of said watercraft.

7. The drive mechanism according to claim 1 or 2, wherein aft of said propeller there is arranged a rudder which is pivotally supported about a substantially vertical axis on said upper part which projects aftwardly from the aft end of said lower part.

8. The drive mechanism according to claim 7, wherein said upper part of said support arm is divided by means of a partition wall into two chambers which extend in longitudinal direction, wherein through one of said chambers the linkage for the pivotal adjusting of the rudder which is arranged behind the propeller is guided, and wherein the other one of said chambers receives the exhaust emissions from said drive motor.

9. The drive mechanism according to claim 8, wherein an exhaust muffler is provided in said other one of said chambers.

10. The drive mechanism according to claim 1 or 2, wherein connections for a cooling water circuit for said drive motor are provided on said lower part of said support arm.

11. The drive mechanism according to claim 1 or 2, wherein said support arm carries on the aft end of said upper part constructed as a cavitation plate a trim rudder which is pivotal about a horizontal axis.

12. The drive mechanism according to claim 11, wherein said trim rudder has a recess in the trailing edge thereof with trailing edge segments straddling said rudder without hindering its pivoting movement.

13. The drive mechanism according to claim 11, wherein said trim rudder is operated through at least one hydraulic cylinder arranged on said upper part, the piston rod of said hydraulic cylinder acting onto a linkage which is connected to said trim rudder, and wherein supply lines are provided and are placed within the interior of said upper part.

14. The drive mechanism according to claim 1 or 2, wherein water-guiding surfaces are provided on both sides of said rib means, said rib means extending in longitudinal direction and are oriented on said rib means extending from the lower part sloped aftwardly to said upper part and are arched both toward the sides and also in their longitudinal direction.

* * * * *